US005287909A

United States Patent [19]

King et al.

[11] Patent Number: 5,287,909

[45] Date of Patent: Feb. 22, 1994

[54] FREESTANDING PRIVACY SCREEN

[75] Inventors: Jonathan J. King, Grand Rapids; Marvin C. Knauf, Conklin; Bruce A. Preston; John C. Fuhs, both of Grand Rapids, all of Mich.

[73] Assignee: Steelcase Inc., Grand Rapids, Mich.

[21] Appl. No.: 988,431

[22] Filed: Dec. 9, 1992

[51] Int. Cl.[5] ..... A47G 5/00

[52] U.S. Cl. ..... 160/135; 160/229.1

[58] Field of Search ..... 160/135, 351, 229.1, 160/233, 234; 52/239, 238.1

[56] References Cited

U.S. PATENT DOCUMENTS

| | | | |
|---|---|---|---|
| 1,588,529 | 6/1926 | Cranshaw | 160/135 |
| 1,887,894 | 11/1932 | Schwab | 52/758 |
| 2,210,652 | 8/1940 | Dennett | 45/108 |
| 2,338,092 | 1/1944 | Brown | 248/172 |
| 2,642,018 | 6/1953 | Weeber | 108/16 |
| 2,890,545 | 6/1959 | Fiddler | 45/139 |
| 2,895,717 | 7/1959 | De Falco | 256/25 |
| 2,914,146 | 11/1959 | Conley | 189/34 |
| 2,938,248 | 5/1960 | Hadary | 20/56.4 |
| 3,049,195 | 8/1962 | Leat et al. | 189/34 |
| 3,158,961 | 12/1964 | Hawkins | 50/211 |
| 3,370,389 | 2/1968 | Macaluso | 52/239 |
| 3,592,288 | 7/1991 | Walter | 181/30 |
| 3,592,289 | 7/1971 | Aysta | 181/30 |
| 3,662,807 | 5/1972 | Miller | 160/135 |
| 3,700,385 | 10/1972 | Sherwood | 160/135 |
| 3,715,847 | 2/1973 | Straus | 52/400 |
| 3,777,437 | 12/1973 | Christen | 52/758 |
| 3,809,142 | 5/1974 | Bleeker | 160/135 |
| 3,868,789 | 3/1975 | Gates | 49/501 |
| 3,875,711 | 4/1975 | Palmer | 52/239 |
| 3,889,315 | 6/1975 | Stouffer | 160/135 X |
| 3,931,771 | 1/1976 | Kramer | 160/135 X |
| 3,949,827 | 4/1976 | Witherspoon | 181/33 |
| 3,979,872 | 9/1976 | Gilchrist et al. | 52/624 |
| 3,986,316 | 10/1976 | Blodee | 52/733 |
| 4,020,604 | 5/1977 | Legler | 52/65 |
| 4,021,973 | 5/1977 | Hegg et al. | 52/36 |
| 4,040,212 | 8/1977 | Goransson | 52/145 |
| 4,127,196 | 11/1978 | Boucher | 211/207 |
| 4,129,163 | 12/1978 | Johnson | 160/135 |
| 4,149,352 | 4/1979 | Allen | 52/476 |
| 4,193,474 | 3/1980 | Okubo et al. | 181/287 |
| 4,416,093 | 11/1983 | Salkeld et al. | 52/71 |
| 4,448,003 | 5/1984 | Hasbrouck | 52/239 |
| 4,448,231 | 5/1984 | Salkeld et al. | 160/135 |
| 4,497,356 | 2/1985 | Luck et al. | 160/135 |
| 4,601,145 | 7/1986 | Wilcox | 52/238.1 |
| 4,823,858 | 4/1989 | Perutz | 160/135 |
| 4,828,005 | 5/1989 | Notley | 160/351 |
| 4,830,080 | 5/1989 | Densen | 160/135 |
| 4,924,931 | 5/1990 | Miller | 160/135 |
| 4,987,713 | 1/1991 | Delafield | 52/400 |
| 4,991,365 | 2/1991 | Jackson | 52/126.6 |
| 5,048,585 | 9/1991 | Miller | 160/135 |
| 5,065,562 | 11/1991 | Larsen et al. | 52/772 |

FOREIGN PATENT DOCUMENTS

| | | |
|---|---|---|
| 955553 | 1/1950 | France . |
| 26700 | 2/1916 | Norway . |
| 1542244 | 3/1979 | United Kingdom . |
| 1542245 | 3/1979 | United Kingdom . |

OTHER PUBLICATIONS

Herman Miller "Relay Furniture" Brochure (2 pages).

*Primary Examiner*—David M. Purol

*Attorney, Agent, or Firm*—Price, Heneveld, Cooper, DeWitt & Litton

[57] ABSTRACT

A freestanding privacy screen comprises a plurality of like panels shaped to be positioned in a side-by-side relationship. Each panel includes a frame on which an insert panel can be mounted, and hollow side members or uprights. A pair of hinge rods are positioned in the hollow uprights of the frame for axial rotation therein, and have first key members positioned adjacent opposite ends thereof. Panel connectors interconnect adjacent panels in a mutually vertically aligned relationship. Each panel connector has a two-part body construction interconnected by a removable fastener to capture associated end portions of adjacent hinge rods therebetween. The connectors have second key members that mate with the first key members on the hinge rod ends which rotationally interconnect adjacent hinge rods, such that when the privacy screen panels are pivoted, the hinge rods retain adjacent panels in their vertically aligned relationship.

33 Claims, 6 Drawing Sheets

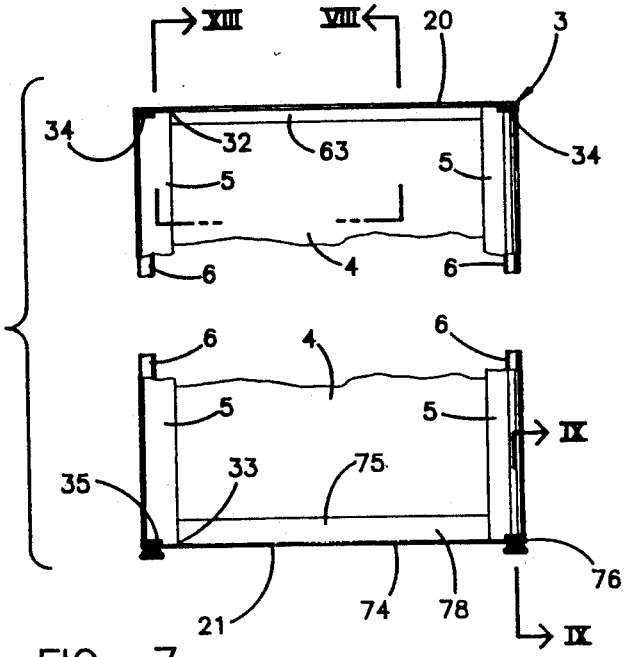
FIG. 7
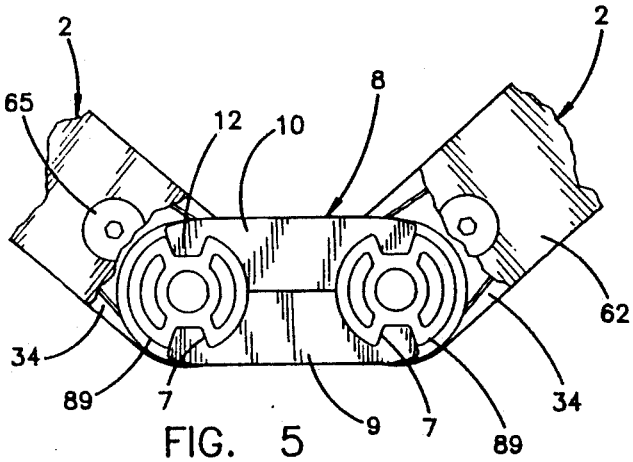
FIG. 5
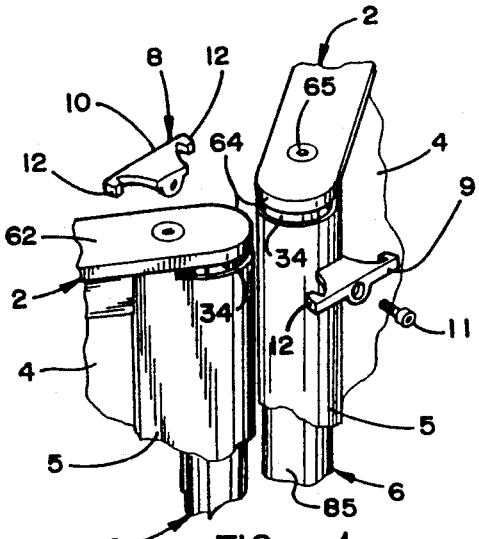
FIG. 4
FIG. 6
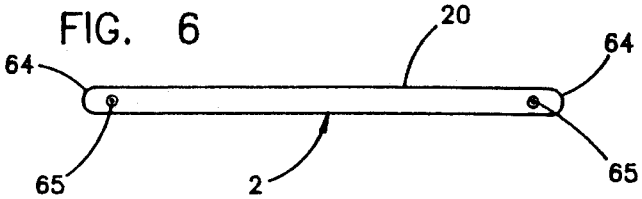

FREESTANDING PRIVACY SCREEN

BACKGROUND OF THE INVENTION

The present invention relates to furnishings for offices and the like, and in particular to a freestanding privacy screen.

Privacy screens are generally well-known in the art, and have been used in some types of office environments to provide additional temporary partitioning. Such privacy screens typically include multiple panels that are interconnected side-by-side in a manner which permits them to be fan folded between an extended use position and a retracted storage position.

Heretofore, freestanding privacy screens have been relatively unstable, and tend to tip over rather readily. Also, such privacy screens are generally difficult to fold or otherwise manipulate, since they are prone to skew and bind when one panel is pivoted relative to the next. This skewing action, particularly in combination with the inherent instability of the basic freestanding screen construction, results in substantial operational difficulties. These problems are greatly exacerbated when the screens are used in high density office settings, where their flexible privacy capabilities are found to be especially beneficial.

SUMMARY OF THE INVENTION

One aspect of the present invention is to provide a freestanding privacy screen, comprising panels configured to be positioned in a side-by-side relationship. Each panel includes a frame on which an insert panel can be mounted. Hinge rods are positioned in the sides of the frame for axial rotation therein, and have first key members positioned adjacent opposite ends thereof. At least one panel connector interconnects adjacent panels in a mutually vertically aligned relationship. The panel connector has a two-part body construction to capture associated end portions of adjacent hinge rods therebetween. The panel connector has a second key member that mates with the first key member on the hinge rod ends to rotationally interconnect adjacent hinge rods, such that when adjacent privacy screen panels are pivoted, the hinge rods retain the adjacent panels in their vertically aligned relationship.

Preferably, the panels have a modular construction, such that the overall width of the privacy screen can be easily varied by quickly connecting or disconnecting selected panels through use of the panel connectors. A stop arrangement permits adjacent panels to assume a maximum included angle which improves screen stability.

The principle objects of the present invention are to provide a freestanding privacy screen that is particularly adapted for use in office environments and the like, and can be readily and reliably shifted into a plurality of different use positions and configurations to support various worker activities. The privacy screen is quite stable, with a positive stop arrangement that prevents it from assuming any unstable configurations. The screen panels include rigid hinge pins that are rotationally interconnected by keyed panel connectors to maintain adjacent panels in a vertically aligned relation, even during folding, so as to alleviate panel skewing and tipping. The privacy screen is lightweight for easy portability, and is very flexible for use in many different settings. The frame is shaped for easy manual grasping, and can accommodate different thickness insert panels to personalize a particular workstation. The freestanding privacy screen is efficient in use, economical to manufacture, capable of a long operating life, and particularly well adapted for the proposed use.

These and other advantages of the invention will be further understood and appreciated by those skilled in the art by reference to the following written specification, claims and appended drawings.

BRIEF DESCRIPTION OF THE DRAWINGS

FIG. 4 is a fragmentary, perspective, exploded view of a corner portion of the privacy screen.

FIG. 5 is an enlarged, fragmentary, top plan view of the corner portion of the privacy screen, with portions thereof broken away to reveal a panel connector.

FIG. 6 is a top plan view of a single panel portion of the privacy screen.

FIG. 7 is a fragmentary, front elevational view of the panel.

DETAILED DESCRIPTION OF THE PREFERRED EMBODIMENTS

Figure 1:
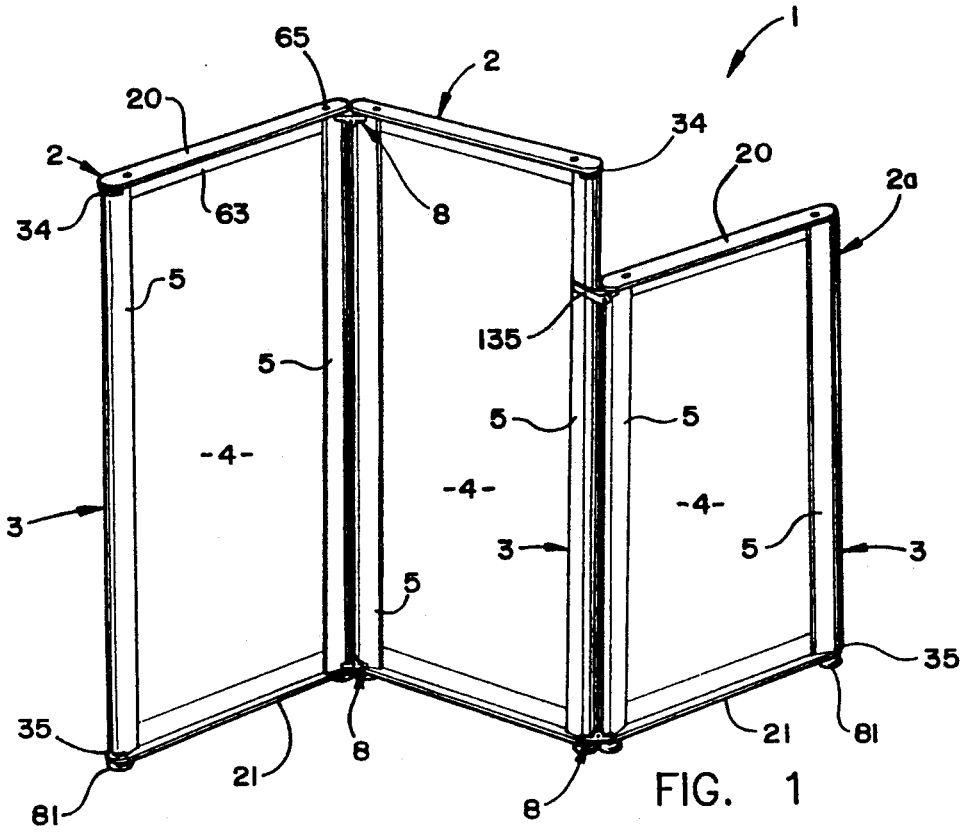
FIG. 1 is a perspective view of a freestanding privacy screen embodying the present invention.

For purposes of description herein, the terms "upper," "lower," "right," "left," "rear," "front," "vertical," "horizontal," and derivatives thereof shall relate to the invention as oriented in FIG. 1. However, it is to be understood the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a freestanding privacy screen embodying the present invention. In the illustrated example, privacy screen 1 comprises a plurality of like, individual panels 2 shaped to be positioned in a side-by-side relationship. Each panel 2 includes a frame 3 with an insert panel 4 mounted thereon, and hollow side members or uprights 5. A pair of hinge rods 6 (FIGS. 4, 5 and 7) are positioned in the hollow uprights 5 of panel frame 3 for axial rotation thereon, and have first key members 7 positioned adjacent opposite ends thereof. Panel connectors 8 interconnect adjacent panels 2 in a mutually vertically aligned relationship. Each panel connector 8 has a two-part, or split body construction with opposite halves 9 and 10 interconnected by a removable fastener 11 to capture associated end portions of adjacent hinge rods 6 therebetween. Panel connectors 8 have second key members 12 that mate with the first key members 7 on the ends of hinge rods 6 to rotationally interconnect adjacent hinge rods 6, such that when the adjacent screen panels 2 are pivoted with respect to one another, hinge rods 6 serve to retain the adjacent panels 2 in their vertically aligned relationship, and thereby alleviate skewing and/or tipping of privacy screen 1.

Figure 10:
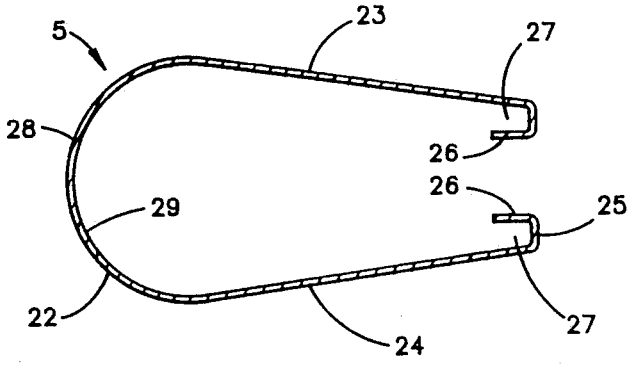
FIG. 10 is an enlarged, horizontal cross-sectional view of a frame side member portion of the panel.

The illustrated panel frame 3 (FIGS. 6–11) extends about the marginal portion of panel 2, and includes a pair of vertically extending, left and right hand side members or uprights 5, which are interconnected by horizontally extending top and bottom frame members 20 and 21 respectively. Panel frame 3 has a generally rectangular front elevational configuration, which defines therebetween an open center area in which an insert panel 4 can be mounted. The left and right hand frame uprights 5 are substantially identical in construction, except that they are mirror images of one another, such that for ease of detailed description herein, reference shall be had to the left hand upright 5 shown in FIGS. 10 and 11, it being understood the right hand upright is generally the same. As best illustrated in FIG. 10, frame upright 5 has an ovately shaped transverse cross-sectional configuration in the nature of a hollow channel, with a thinner portion thereof oriented inwardly, and a thicker portion thereof oriented outwardly to facilitate grasping and manual adjustment of privacy screen 1. More specifically, frame upright 5 includes an arcuate central web 22 from which a pair of side flanges 23 and 24 extend inwardly in a tapered or inclined fashion. Web 22 is preferably semi-circular in plan configuration, whereas opposite side flanges 23 and 24 are generally planar or flat, and terminate in inwardly turn free ends with an L-shaped configuration defined by flange legs 25 and 26. Panel frame flanges 23–26 define a pair of inwardly opening channels 27 along the interior edge of upright 5 for purposes to be described in greater detail hereinafter. In the illustrated example, frame upright 5 may be constructed from a formed sheet metal material or the like, wherein the ovate or tear drop shape of exterior surface 28 is particularly adapted for grasping, and the opposite interior surface 29 is adapted to mount hinge rods 6 therein, as explained below.

Figure 11:
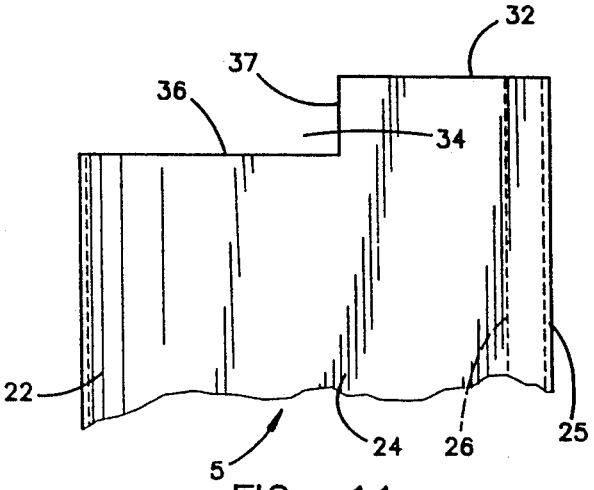
FIG. 11 is an enlarged, fragmentary, side elevational view of the frame side member.
Figure 14:
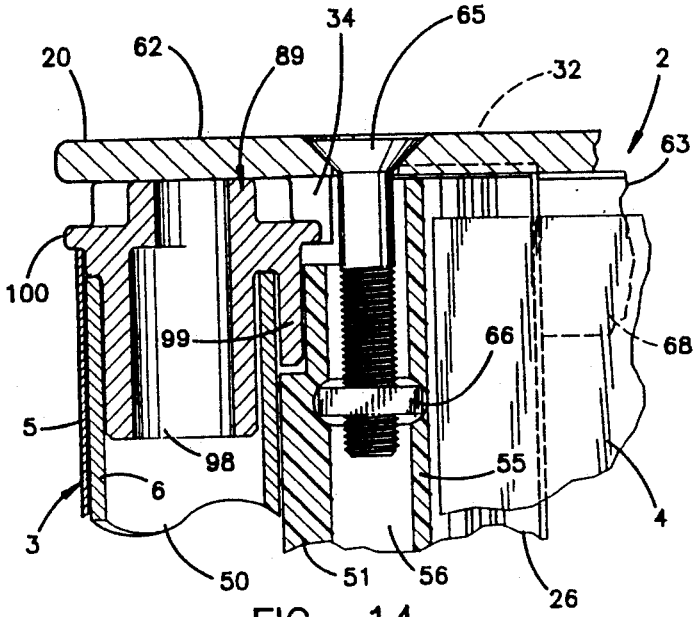
FIG. 14 is an enlarged, fragmentary, vertical cross-sectional view, of a corner portion of the panel.
Figure 13:
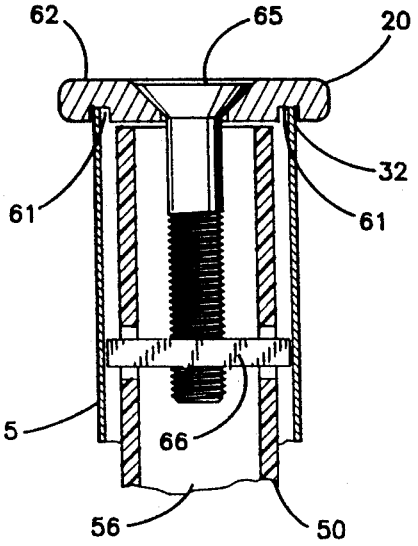
FIG. 13 is an enlarged, fragmentary, vertical cross-sectional view of the panel, taken along the line XIII—XIII, FIG. 7.

Both the left and right hand uprights 5 extend generally continuously between top and bottom edges 32 and 33, adjacent frame members 20 and 21 respectively, and have a substantially uniform lateral cross-sectional shape therealong. As best illustrated in FIGS. 7 and 11, the left and right hand uprights 5 each include a pair of notches or windows 34 and 35 at opposite ends thereof. Windows 34 and 35 are substantially rectangular cutouts through the outside edge of upright 5, and are defined by a top edge 36 and a perpendicular side edge 37. Windows 34 and 35 are shaped to receive panel connectors 8 therethrough, and thereby provide lateral access to the associated hinge rods 6, as described herein below.

With reference to FIGS. 13–16, each of the illustrated frame uprights 5 includes a screen retainer 50 mounted within the hollow interior thereof. Screen retainer 50 includes an arcuate base 51 shaped to rotatably receive an associated hinge rod 6 thereagainst. Screen retainer base 51 includes a tab or stop 52 projecting outwardly therefrom toward associated hinge rod 6, which serves to limit axial rotation of hinge rod 6 within frame upright 5, as described in greater detail below. Screen retainer 50 also includes a pair of side flanges 53 and 54 which extend inwardly from base 51 in a generally mutually parallel fashion. A lateral rib 55 is spaced inwardly from base 51, and interconnects side flanges 53 and 54, and defines a closed channel 56 therebetween. The inwardly oriented ends 57 of screen retainer side flanges 53 and 54 are tapered inwardly, and are closely received within channels 27 of frame upright 5. A pair of blades or wipers 58 project inwardly in an oppositely facing fashion from the interior sides of both retainer flange ends 57, and are adapted to receive an associated insert panel 4 therebetween. Wipers 58 are preferably resiliently flexible, such that different thickness insert panels 4 can be received and securely retained therein without rattling. Preferably, screen retainer 50 has a one-piece integrally molded construction, such as a strip of extruded synthetic resin material. The illustrated screen retainer 50 extends continuously between the upper and lower edges 32 and 33 of frame upright 5.

The illustrated panel insert 4 is a rigid sheet, having a rectangular side elevational shape configured to have marginal edges thereof received within the interior of panel frame 3. Preferably, multiple panel inserts 4 with different style exterior surfaces and/or finishes are available, so that privacy screen 1 can be configured with various appearances and/or utilitarian capabilities. For example, panel inserts 4 may be provided in a wide variety of different upholstered fabrics, wall coverings, veneers, etc. to match with other furniture and/or building decor, and may also include functional surfaces, such as porcelain finish marker boards, tackboards, transparent and translucent materials, and the like. Even though the various panel inserts 4 have different thicknesses, each can be mounted within any of the panel frames 3 due to the flexible retention arrangement provided by the wipers 58 of screen retainers 50. Screen retainers 50 provide a clean, neat framed appearance along the opposite sides of panel 2, and also serve as light seals therealong. Panel 2 can be configured without a panel insert 4, in which case, the center portion of panel frame 3 is left completely open.

Frame top 20 (FIGS. 6–8) comprises a top rail assembly having a top plate 62 with a U-shaped channel 63 mounted along the bottom surface thereof. Top plate 62 has a width substantially commensurate with the outside diameter of upright web 22, and includes rounded ends 64 which overly the upper ends 34 of frame uprights 5, and enclose the same. The lower surface of top plate 62 includes a groove 61 (FIG. 13) in which the upper end 32 of upright 5 is received so as to fixedly interconnect the same, and prevent frame uprights 5 from rotating independently from their associated panel 2. A pair of countersunk cap screws 65 (FIGS. 13 and 14) extend through mating apertures at opposite ends of top plate 62, and have their lower ends threadedly secured in mating T-nuts 66 mounted transversely in the closed channel 56 of screen retainer 50, so as to securely mount top rail assembly 20 to panel frame 3. The channel 63 (FIGS. 7 and 8) of top rail assembly 20 is positioned to open downwardly along the lower surface of top plate 62, and includes a central web 67, with a pair of depending flanges 68. Flanges 68 are spaced apart a distance sufficient to loosely capture a marginal edge portion of an associated insert panel 4 therebetween. Preferably, channel flanges 68 are spaced apart a distance sufficient to receive the thickest one of the various insert panels 4 available with privacy screen 1.

Panel frame bottom 21 (FIGS. 7–9) comprises a bottom rail assembly, having a bottom plate 74 with a U-shaped channel 75, upstanding along the upper surface thereof. Bottom plate assembly 21 is similar in construction to top plate assembly 20, wherein bottom plate 74 is shaped to cover the bottom edges 33 of frame uprights 5, and includes arcuately shaped ends 76. Channel 75 also has a central web (not shown) attached to the upper surface of bottom plate 74, and a pair of spaced apart side flanges 78 shaped to receive an associated insert panel 4 therebetween. A groove (not shown), similar to groove 61, is provided in the upper surface of bottom plate 74 in which the lower edge 33 of frame upright 5 is received. Bottom rail assembly 21 is attached to the bottom of panel frame 3 in a manner similar to top rail assembly 20, with a pair of upwardly extending countersunk cap screws (not shown) received in mating T-nuts (not shown) mounted in the lower ends of the closed channels 56 in screen retainers 50. Bottom plate 74 also includes a pair of threaded apertures 79 (FIG. 9) at opposite ends thereof in which threaded studs 80 associated with adjustable glide feet 81 are mounted.

It is to be noted that each panel 2 is securely interconnected by using only four fasteners 65. Since insert panels 4 are simply captured within panel frame 3, each panel 2 can be readily reconfigured with a different insert panel 4 by detaching the four fasteners 65, sliding the existing panel insert 4 out from inbetween, opposite screen retainers 50, inserting the new insert panel 4, and then reassembling frame 3 with fasteners 65. This construction permits personalizing privacy screen 1 for a particular user and/or environment.

Figure 12:
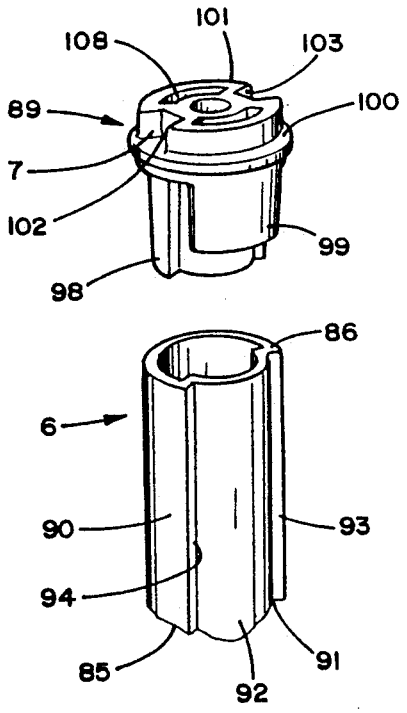
FIG. 12 is a fragmentary, exploded perspective view of a hinge rod portion of the panel.
Figure 15:
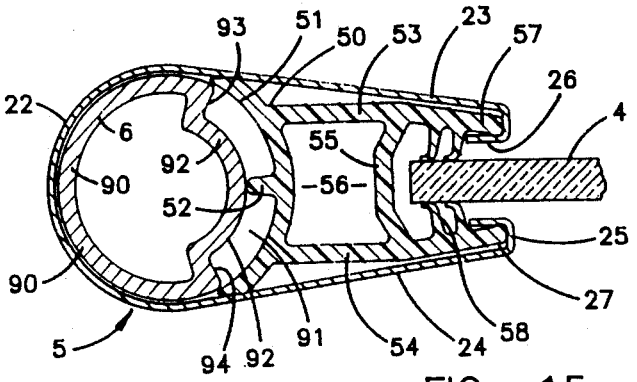
FIG. 15 is an enlarged, horizontal cross-sectional view of the corner portion of the panel, shown with a stop portion thereof in an intermediate position.
Figure 16:
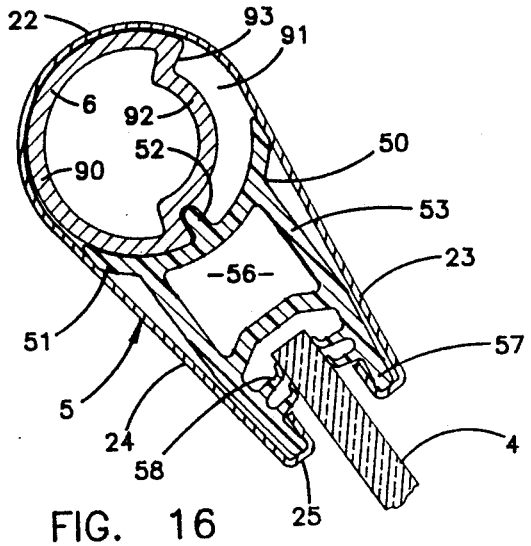
FIG. 16 is an enlarged, horizontal, cross-sectional view of the corner portion of the panel, with the stop portion shown in a fully extended position.

Each panel frame 3 includes a pair of rigid hinge rods 6, which are rotatably mounted within the hollow interior of opposite frame uprights 5. In the illustrated example, hinge rods 6 have a substantially identical, multipiece construction, which as best illustrated in FIG. 12, includes a tube 85 having upper and lower ends 86 and 87 (FIG. 9) respectively, with a pair of keyed inserts or hinge caps 89 (FIG. 12) mounted therein. Tube 85 has a cylindrically shaped outer wall 90 adapted to be closely received within the interior of frame upright 5, and mating with the circular inside surface 29 of upright web 22. The illustrated tube outer wall 90 (FIGS. 15 and 16) extends radially approximately 140–160 degrees so as to insure smooth axial rotation of each hinge rod 6 against surface 29 of the associated frame upright 5. Preferably, each hinge rod 6 is configured to achieve a friction fit with the adjacent interior surface 29 of arcuate upright web 22, and the base 51 of screen retainer 50 to assist in alleviating panel skewing, while permitting manual angular adjustment between adjacent panels 2. A groove 91, defined by arcuate tube inner wall 92 and associated end walls 93 and 94, extends longitudinally and continuously along one side of tube 85, opposite tube wall 90, and receives the stop 52 of an adjacent screen retainer 50 therein. As best illustrated in FIGS. 15 and 16, screen retainer stop 52 projects inwardly into tube groove 91. Abutting contact between screen retainer stop 52 and the opposite endwalls 93 and 94 of tube groove 91 serve to limit mutual rotation between hinge rod 6 and associated frame upright 5 for screen stability purposes, as described in greater detail hereinafter.

Figure 17:
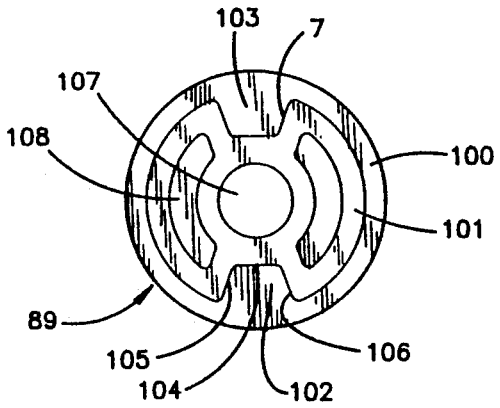
FIG. 17 is an enlarged, top plan view of a hinge rod insert portion of the panel.
Figure 18:
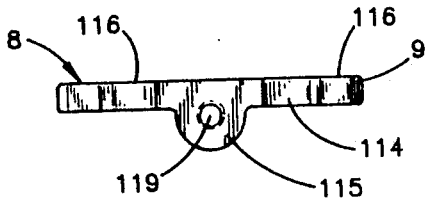
FIG. 18 is a side elevational view of a first half of the panel connector.
Figure 20:
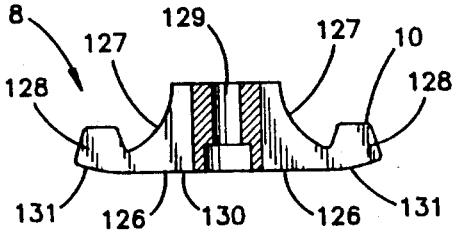
FIG. 20 is a horizontal, cross-sectional view of a second half of the panel connector.
Figure 19:
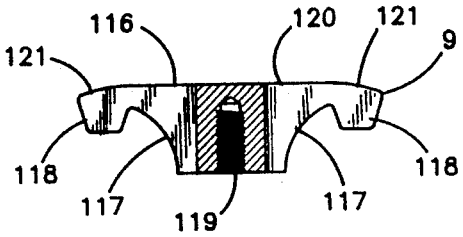
FIG. 19 is a horizontal cross-sectional view of the panel connector first half.
Figure 21:
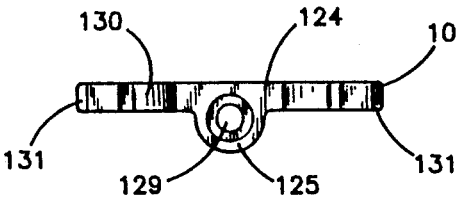
FIG. 21 is a side elevational view of the panel connector second half.

Hinge caps 89 (FIG. 12) are telescopingly received and mounted in the opposite ends of tube 85, and includes the first key member 7 thereon to mate with an associated panel connector 8. In the illustrated example, hinge caps 89 are identical, wherein each includes a base 98 which is shaped similar to the hollow interior of hinge rod tube 85, and is telescopingly received therein. A locking tab or key 99 extends outwardly adjacent base 98, and is received within groove 91 at the uppermost portion of tube 85 to rotationally lock hinge cap 89 on hinge rod 6. A circular rim 100 extends about the upper portion of hinge cap base 98 and tab 99, and overlies the upper and lower ends 86 and 87 of tube 85. As best illustrated in FIG. 17, the key member 7 on hinge cap 89 comprises an annular disc 101 mounted concentrically on rim 100, with a pair of notches 102 and 103 formed through opposite marginal edge portions thereof. Notches 102 and 103 each have a tapered plan configuration, in the nature of a truncated V, defined by a straight base edge 104, and oppositely inclined side edges 105 and 106. Hinge cap 89 also includes a central cylindrical aperture 107, and a pair of arcuate slots 108. A pair of hinge caps 89 are mounted in the opposite ends of hinge rod tube 85 by an interference, friction fit, or other similar fastener arrangement.

Figure 22:
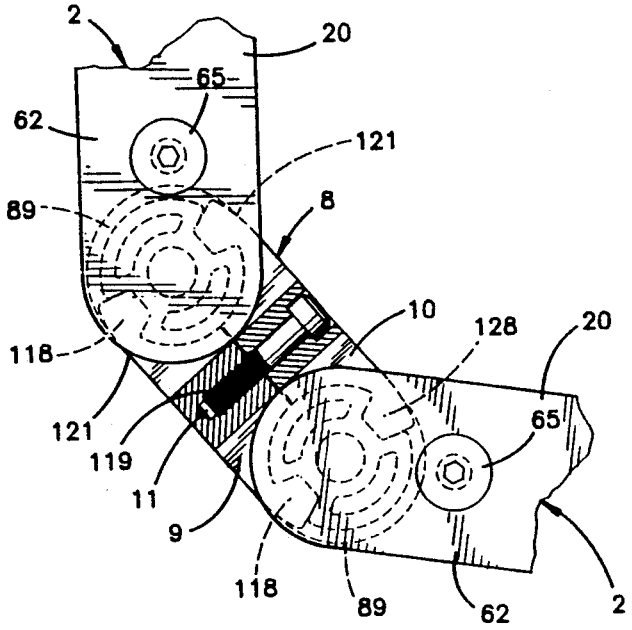
FIG. 22 is an enlarged, fragmentary, top plan view of a corner portion of the privacy screen, wherein portions thereof have been broken away to show the panel connector when adjacent panels are oriented in a fully extended use position.
Figure 23:
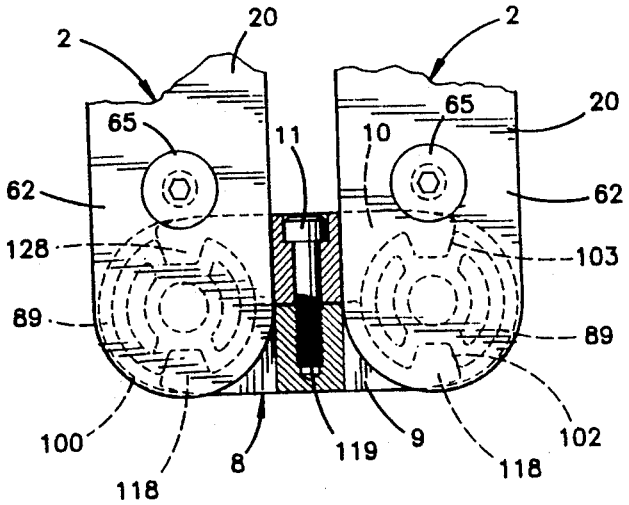
FIG. 23 is an enlarged, fragmentary, top plan view of the corner portion of the privacy screen, wherein portions thereof have been broken away to show the panel connector when adjacent panels are in a fully folded storage position.

With reference to FIGS. 18–23, the illustrated panel connectors 8 are substantially identical, wherein each includes two opposite connector halves 9 and 10 interconnected by single threaded fastener 11. Connector half 9 (FIGS. 18 and 19) includes a flat plate 114 with a centrally located fastener housing 115 projecting downwardly therefrom. Connector plate 114 has a generally T-shaped plan configuration in the nature of a yoke, with arms 116 extending outwardly on opposite sides of fastener housing 115. The interior sides of arms 116 include arcuate edges 117 which define cutouts or notches in which an annular disc 101 of an associated hinge cap 89 is received. An inwardly facing, wedge shaped tooth or tab 118 is positioned at the end of each connector arm 116, and is configured to be closely received within an associated notch 102 and 103 in hinge cap 89. Fastener housing 115 has a semi-cylindrical construction, and includes a threaded aperture 119 adapted to receive the threaded end of fastener 11 therein. The outer edge 120 of connector plate 114 has inwardly curved end portions 121, which are configured to mate and blend in with the rim portion 100 of an associated hinge cap 89 and plate end 64, as shown in FIGS. 22 and 23.

The opposite half 10 of panel connector 8 is similar in construction to connector half 9, and includes a flat plate 124, a fastener housing 125, and opposite arms 126. Curved edges 127 are formed along the interior sides of plate 124, and are shaped to receive associated annular disc 101 of hinge caps 89 therein. Wedge shaped teeth or tabs 128 are formed in the opposite ends of arms 126. Fastener housing 125 includes a countersunk through aperture 129 therein in which the head portion of fastener 11 is received. The outer edge 130 of panel connector half 10 has curved end portions 131 which mate and blend in with the portion rim 100 of an associated hinge cap 89, and plate end 64.

In operation, privacy screen 1 is configured by ganging or interconnecting a selected number of panels 2 by using panel connectors 8. For each pair of adjacent panels 2, two panel connectors 8 are required. The modular construction of panels 2 permits any selected number of panels 2 to be easily interconnected and/or disconnected without regard to their left-to-right orientation, so as to adjust the overall width of privacy screen 1. The opposite halves 9 and 10 of each panel connector 8 are positioned on opposite sides of the adjacent panels 2, and are inserted through the windows 34 in the opposite ends of adjacent frame uprights 5. The wedge shaped tabs 118 and 128 on opposite connector halves 9 and 10 are respectively positioned in the associated notches 102 and 103 in hinge caps 89 at the opposite ends of adjacent hinge rods 6. A fastener 11 is inserted through aperture 129 in each connector half 10 and threaded into aperture 119 in each opposite connector half 9, and then tightened in place, so as to capture the ends of adjacent hinge rods 6 therebetween. Engagement between connector tabs 118 and 128 and hinge cap notches 102 and 103 serves to rotationally interconnect or link adjacent hinge rods 6, such that when adjacent panels 2 are pivoted with respect to one another, the panels 2 are retained in their mutually vertically aligned relationship, and do not skew or tip.

Figure 2:
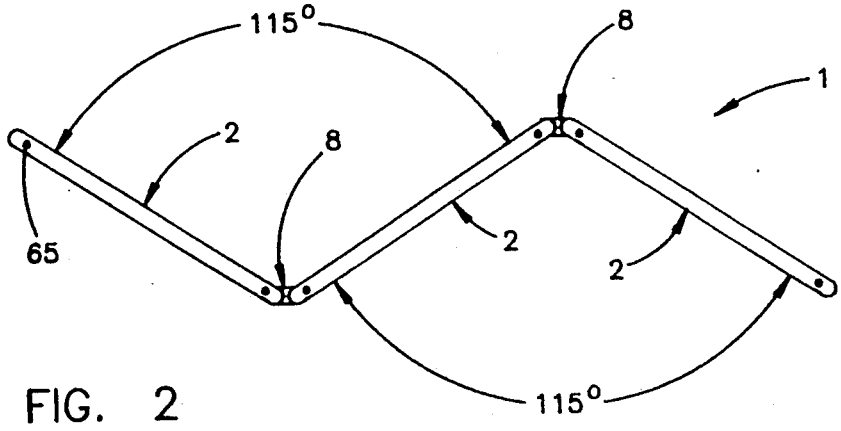
FIG. 2 is a top plan view of the privacy screen, shown in an extended use position.
Figure 3:
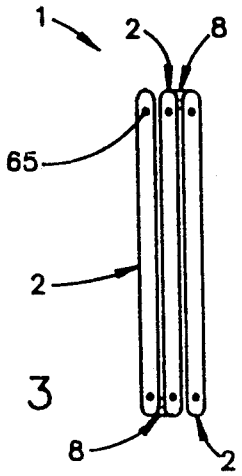
FIG. 3 is a top plan view of the privacy screen, shown in a folded storage position.
Figure 8:
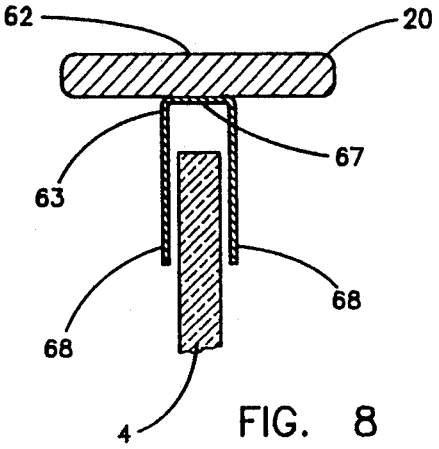
FIG. 8 is an enlarged, fragmentary, vertical cross-sectional view of the panel, taken along the line VIII—VIII, FIG. 7.
Figure 9:
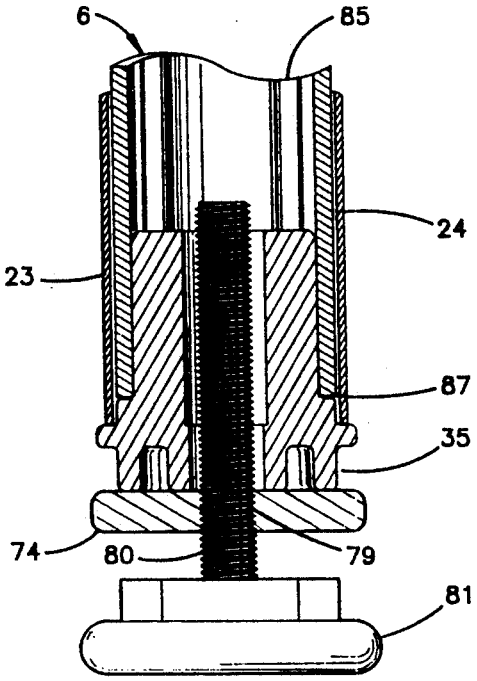
FIG. 9 is an enlarged, fragmentary, vertical cross-sectional view of the panel, taken along the line IX—IX, FIG. 7.

Panel connectors 8 permit adjacent panels 2 to be interconnected in either a "Z" configuration as shown in FIGS. 1-3, or a "C" configuration (not shown), wherein three adjacent panels 2 assume a generally trapezoidal plan shape. Panels 2 are readily reconfigured between the "Z" and "C" configurations by simply removing the panels connectors 8, and rotating the associated hinge rods 6 to their correct orientation to insure that stops 52 permit mutual pane pivoting as desired.

Figure 24:
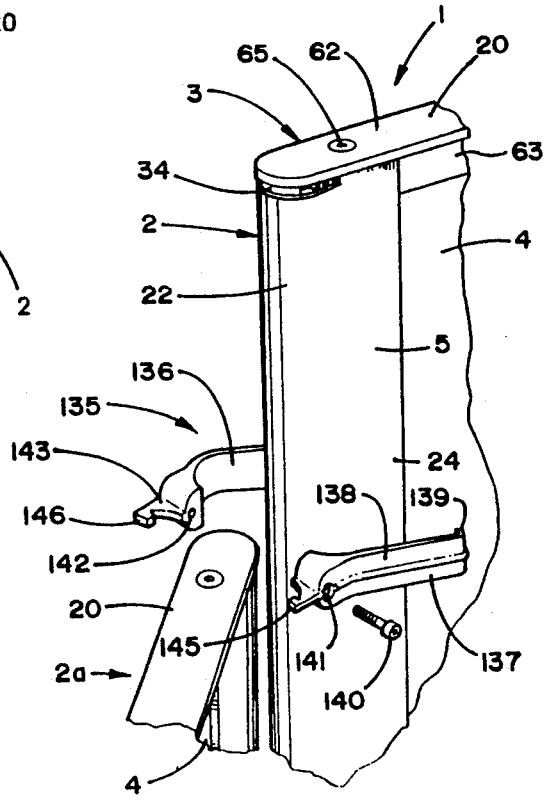
FIG. 24 is a fragmentary, exploded, perspective view of the privacy screen and an alternate height panel with a change-of-height bracket for interconnecting the same.

As best illustrated in FIGS. 1 and 24, panels 2 may be provided in various heights. In the illustrated examples, two panels 2 of similar height are interconnected in the manner described above. A low panel **2*a* is interconnected with this two-panel assembly through the use of a change-of-height bracket 135. With reference to FIG. 24, change-of-height bracket 135 comprises a pair of arm-shaped bracket halves 136 and 137, which are shaped for positioning on opposite sides of adjacent panel upright 5. Both of the bracket halves 136 and 137 includes a clamp arm 138 with an inwardly turned end 139 which abuts and frictionally engages the adjacent outside surfaces of associated frame upright 5. A threaded fastener 140 extends through mating apertures 141 and 142 in bracket halves 136 and 137 to interconnect the same, thereby clamping arms 138 against the opposite sides of frame upright 5. Bracket halves 136 and 137 also both include a keying arm 143, which is shaped similar to the arms 116 and 126 of connector halves 9 and 10, and have wedge shape teeth or tabs 145 and 146 received in the notches 102 and 103 of associated hinge caps 89. The illustrated change-of-height bracket 135 securely interconnects the upper end of low panel 2*a* with the frame upright 5 of an adjacent full panel 2. The lower end of low panel 2*a* is connected with the lower end of full panel 2 by a panel connector 8**, as described hereinabove.

Privacy screen 1 may be arranged as a completely freestanding unit, as shown in FIGS. 1-3, or connected with adjacent furniture and/or building structure. A tether (not shown) may be used to anchor privacy screen 1 to another object to prevent it from being removed from a specified area, yet permit it to be folded between the extend use and retracted storage positions.

The rotational mounting of hinge rods 6 in frame uprights 5, permits panels 2 to be manually pivoted with respect to one another. Preferably, panels 2 are pivotedly manipulated between an extended use position, as illustrated in FIG. 2, and a retracted or folded storage position, as shown in FIG. 3. When panels 3 are pivoted to the extended use position, as illustrated in FIG. 2, abutting contact between screen retainer stops 52 and an associated one of the hinge rod sidewalls 93 or 94 permits adjacent panels 2 to assume a maximum included angle in the range of 90–140 degrees, so as to improve screen stability. In the illustrated structure, stop 52 and mating groove walls 93 and 94 are configured to permit a maximum included angle of around 115 degrees, which permits maximum horizontal extension for full partition capabilities while maintaining upright stability.

Freestanding privacy screen 1 is particularly adapted for use in office environments and the like, and can be readily and reliably shifted into a plurality of different use positions and configurations to support various worker activities. Privacy screen 1 has a unique modular construction which permits it to be easily configured and reconfigured into different widths. Privacy screen 1 is quite stable, with positive stops 52 which prevent it from assuming unstable configurations. Hinge rods 6 in conjunction with keyed panel connectors 8 serve to maintain adjacent panels in a vertically aligned relationship, even during folding, so as to alleviate panel skewing and tipping.

The embodiments of the invention in which an exclusive property or privilege is claimed are defined as follows.

1. A freestanding privacy screen, comprising:

a plurality of panels configured to be positioned in a side-by-side relationship; each of said panels including:

a frame having hollow side members with opposite ends;

a pair of hinge rods positioned within the hollow side members of said frame for axial rotation therein, and extending continuously between the opposite ends of said side members; said hinge rods being rigid, and including first key members positioned adjacent opposite ends thereof;

a plurality of panel connectors interconnecting said panels and retaining the same in a mutually vertically aligned relationship; each of said panel connectors including:

a split body construction with mating body halves, each of which includes a pair of reception areas shaped to receive portions of adjacent hinge rods therein;

means for detachably interconnecting said mating body halves, whereby adjacent hinge rods are captured therebetween adjacent the opposite ends thereof to thereby securely yet releasably retain adjacent ones of said panels in said side-by-side relationship; and second key members mating with said first key members on said adjacent hinge rods to rotationally interconnect said adjacent hinge rods, whereby upon relative pivoting of said adjacent panels to adjust said privacy screen, said adjacent hinge rods retain said adjacent panels in said mutually vertically aligned relationship.

2. A freestanding privacy screen as set forth in claim 1, wherein:

said adjacent panels have a substantially identical configuration, whereby additional ones of said panels may be readily connected with said adjacent panels by said panel connectors to vary the width of said privacy screen.

3. A freestanding privacy screen as set forth in claim 2, wherein:

said panel connectors and said hinge rods are configured to permit said adjacent panels to be pivoted between an extended use position wherein said adjacent panels assume a mutually angular relationship, and a retracted storage position wherein said adjacent panels are folded over against one another.

4. A freestanding privacy screen as set forth in claim 3, including:

a stop positioned to permit said adjacent panels to assume a maximum included angle in the range of 90–140 degrees when in said extended use position, so as to improve screen stability.

5. A freestanding privacy screen as set forth in claim 4, wherein:

said stop is configured such that said maximum included angle is around 115 degrees.

6. A freestanding privacy screen as set forth in claim 5, wherein:

said frame side members include windows through exterior sides thereof adjacent their opposite ends, shaped to receive said connectors therein and thereby provide lateral access to said hinge rods.

7. A freestanding privacy screen as set forth in claim 6, wherein:

said frame side members have an ovately shaped transverse cross-sectional configuration, with a thinner portion thereof oriented inwardly, and a thicker portion thereof oriented outwardly to facilitate grasping and manual adjustment of said privacy screen.

8. A freestanding privacy screen as set forth in claim 7, wherein:

said hinge rods are closely received in said frame side members to create a friction fit therebetween to facilitate retaining said adjacent panels in their set position, yet permit manual angular adjustment therebetween.

9. A freestanding privacy screen as set forth in claim 8, wherein:

said frame extends about a marginal portion of said panel, and has an open interior defined therebetween;

and including an insert panel mounted within said marginal frame, and enclosing the open interior thereof.

10. A freestanding privacy screen as set forth in claim 9, wherein:

said frame side members include retainers shaped to receive and mount therein one of a plurality of said panel inserts of different thicknesses.

11. A freestanding privacy screen as set forth in claim 10, wherein:

said retainers are resilient, and are shaped to capture edge portions of said one panel to securely retain the same therein and alleviate rattling.

12. A freestanding privacy screen as set forth in claim 11, wherein:

said hinge rods have a hollow construction with inserts mounted in opposite ends thereof in which said first key members are disposed.

13. A freestanding privacy screen as set forth in claim 12, wherein:

said first key members comprise notches in said inserts; and said second key members comprise teeth on the mating body halves of said connectors, shaped to be closely received in the notches of said inserts.

14. A freestanding privacy screen as set forth in claim 13, including:

an alternate height panel having a construction substantially identical to said adjacent panels, except being of a different height; and a change-of-height bracket detachably connecting said alternate height panel with one of said adjacent panels in a side-by-side, vertically aligned relationship therewith.

15. A freestanding privacy screen as set forth in claim 14, wherein:

said connector body interconnecting means comprises a single threaded fastener.

16. A freestanding privacy screen as set forth in claim 1, wherein:

said panel connectors and said hinge rods are configured to permit said adjacent panels to be pivoted between an extended use position wherein said adjacent panels assume a mutually angular relationship, and a retracted storage position wherein said adjacent panels are folded over against one another.

17. A freestanding privacy screen as set forth in claim 16, including:

a stop positioned to permit said adjacent panels to assume a maximum included angle in the range of 90–140 degrees when in said extended use position, so as to improve screen stability.

18. A freestanding privacy screen as set forth in claim 17, wherein:

said stop is configured such that said maximum included angle is around 115 degrees.

19. A freestanding privacy screen as set forth in claim 1, wherein:

said frame side members include windows through exterior sides thereof adjacent their opposite ends, shaped to receive said connectors therein and thereby provide lateral access to said hinge rods.

20. A freestanding privacy screen as set forth in claim 1, wherein:

said frame side members have an ovately shaped transverse cross-sectional configuration, with a thinner portion thereof oriented inwardly, and a thicker portion thereof oriented outwardly to facilitate grasping and manual adjustment of said privacy screen.

21. A freestanding privacy screen as set forth in claim 1, wherein:

said hinge rods are closely received in said frame side members to create a friction fit therebetween to facilitate retaining said adjacent panels in their set position, yet permit manual angular adjustment therebetween.

22. A freestanding privacy screen as set forth in claim 1, wherein:

said frame extends about a marginal portion of said panel, and has an open interior defined therebetween;

and including an insert panel mounted within said marginal frame, and enclosing the open interior thereof.

23. A freestanding privacy screen as set forth in claim 1, wherein:

said frame side members include retainers shaped to receive and mount therein one of plurality of said panel inserts of different thicknesses.

24. A freestanding privacy screen as set forth in claim 1, wherein:

said hinge rods have a hollow construction with inserts mounted in opposite ends thereof in which said first key members are disposed.

25. A freestanding privacy screen as set forth in claim 1, including:

an alternate height panel having a construction substantially identical to said adjacent panels, except being of a different height; and a change-of-height bracket detachably connecting said alternate height panel with one of said adjacent panels in a side-by-side, vertically aligned relationship 26. A freestanding privacy screen as set forth in claim 1, wherein:

said connector body interconnecting means comprises a single threaded fastener.

27. A freestanding privacy screen, comprising:

first and second panels positioned in a side-by-side relationship, and each including:

a frame having hollow side members with opposite ends;

a pair of hinge rods positioned within the hollow side members of said frame for axial rotation therein, and extending continuously between the opposite ends of said side members; said hinge rods being rigid, and each including first key members positioned adjacent opposite ends thereof;

at least one panel connector interconnecting said first and second panels, and retaining the same in a mutually vertically aligned relationship; said panel connector including:

a split body construction with mating body halves, each of which includes a pair of reception areas shaped to receive portions of adjacent hinge rods therein;

means for detachably interconnecting said mating body halves, whereby adjacent hinge rods are captured therebetween adjacent the opposite ends thereof to thereby securely yet releasably retain said first and second panels in said side-by-side relationship; and second key members mating with said first key members on said adjacent hinge rods to rotationally interconnect the same, whereby upon relative pivoting of said first and second panels to adjust said privacy screen, said adjacent hinge rods retain said first and second panels in said mutually vertically aligned relationship.

28. A freestanding privacy screen as set forth in claim 27, including:

a stop positioned to permit said adjacent panels to assume a maximum included angle in the range of 90–140 degrees when in an extended use position, so as to improve screen stability.

29. A freestanding privacy screen as set forth in claim 27, wherein:

said frame side members include windows through exterior sides thereof adjacent their opposite ends, shaped to receive said connector therein and thereby provide lateral access to said hinge rods.

30. A freestanding privacy screen as set forth in claim 27, wherein:

said frame side members have an ovately shaped transverse cross-sectional configuration, with a thinner portion thereof oriented inwardly, and a thicker portion thereof oriented outwardly to facilitate grasping and manual adjustment of said privacy screen.

31. A freestanding privacy screen as set forth in claim 25, wherein:

said hinge rods are closely received in said frame side members to create a friction fit therebetween to facilitate retaining said adjacent panels in their set position, yet permit manual angular adjustment therebetween shaped to receive opposite end portions of adjacent hinge rods therein to thereby securely yet releasably retain adjacent ones of said panels in said side-by-side relationship.

32. A freestanding privacy screen as set forth in claim 31, wherein:

said frame extends about a marginal portion of said panel, and has an open interior defined therebetween;

and including an insert panel mounted within said marginal frame, and enclosing the open interior thereof.

33. A freestanding privacy screen, comprising:

a plurality of panels configured to be positioned in a side-by-side relationship; each of said panels including:

a marginal frame having side members with opposite ends;

an insert panel positioned within said marginal frame;

a pair of rigid hinge rods disposed in the side members of said marginal frame for axial rotation therein, and extending continuously between the opposite ends of said side members;

a plurality of panel connectors interconnecting said panels and retaining the same in a mutually vertically aligned relationship; each of said panel connectors including:

a rigid body connector shaped to receive portions of adjacent hinge rods therein;

means for detachably interconnecting said mating body halves, whereby adjacent hinge rods are captured therebetween adjacent the opposite ends thereof to thereby securely yet releasably retain adjacent ones of said panels in said side-by-side relationship; and second key members mating with said first key members on said adjacent hinge rods to rotationally interconnect said adjacent hinge rods, whereby upon relative pivoting of said adjacent panels to adjust said privacy screen, said adjacent hinge rods retain said adjacent panels in said mutually vertically aligned relationship.

* * * * *